US008286754B2

(12) United States Patent
Cohn

(10) Patent No.: US 8,286,754 B2
(45) Date of Patent: Oct. 16, 2012

(54) VERTICAL LIFT PLATFORM ASSEMBLY

(75) Inventor: Alan R. Cohn, Lockeford, CA (US)

(73) Assignee: Lift-U, Division of Hogan Mfg., Inc., Escalon, CA (US)

( * ) Notice: Subject to any disclaimer, the term of this patent is extended or adjusted under 35 U.S.C. 154(b) by 634 days.

(21) Appl. No.: 11/750,277

(22) Filed: May 17, 2007

(65) Prior Publication Data

US 2008/0283340 A1 Nov. 20, 2008

(51) Int. Cl.

| | |
|---|---|
| ***B66B 9/02*** | (2006.01) |
| ***B66F 7/12*** | (2006.01) |
| ***B66F 3/08*** | (2006.01) |
| *B66B 9/08* | (2006.01) |

(52) U.S. Cl. ..... 187/267; 187/200; 254/89 R; 254/92

(58) Field of Classification Search ..... 187/200, 187/267, 214, 213, 215; 254/92, 98, 7 C, 254/89 R, 90; 182/37, 39, 69.6, 141; 414/495, 414/921

See application file for complete search history.

(56) References Cited

U.S. PATENT DOCUMENTS

| | | | | |
|---|---|---|---|---|
| 2,800,200 | A * | 7/1957 | Wallace | 187/214 |
| 3,237,722 | A * | 3/1966 | Citroen | 187/208 |
| 3,524,563 | A | 8/1970 | McCartney | |
| 3,680,836 | A * | 8/1972 | Amelotte et al. | 254/426 |
| 3,743,247 | A * | 7/1973 | Willke et al. | 254/89 R |
| 3,985,207 | A * | 10/1976 | Petit | 187/208 |
| 5,154,569 | A | 10/1992 | Eryou | |
| 5,595,465 | A | 1/1997 | Knott | |
| 5,938,382 | A | 8/1999 | Andre | |
| 6,327,925 | B1 * | 12/2001 | Gombert et al. | 74/110 |

* cited by examiner

*Primary Examiner* — Michael Mansen
*Assistant Examiner* — Stefan Kruer
(74) *Attorney, Agent, or Firm* — Christensen O'Connor Johnson Kindness PLLC

(57) ABSTRACT

A vertical lift platform assembly 100 has a lift platform 140, which is translatable in a vertical direction between at least a raised position and a lowered position by at least one actuator 200. The lift platform 140 may be surrounded on all sides by vertically extending walls 112 and one or more doors 110 to provide access to the lift platform 140. A control panel 113 enables an operator to control the vertical travel of the lift platform 140.

13 Claims, 12 Drawing Sheets

VERTICAL LIFT PLATFORM ASSEMBLY

TECHNICAL FIELD

The present application relates to vertical lift platforms and, more particularly, to low-rise vertical lift platform assemblies.

BACKGROUND

Persons with mobility impairments often depend on a wheelchair or walking aid to facilitate mobility. As a result, they are frequently subjected to physical barriers and obstacles, such as stairs and curbs. The Americans with Disabilities Act requires that these physical barriers be removed. To that end, ramps have been designed to provide some access; however, ramps can be very long and difficult to climb. Further, depending on the elevation change and available space, ramps may be impractical.

One solution is vertical lifts. Vertical lifts have been developed for use in a wide variety of settings including church pulpits, meeting chamber podiums, and courtrooms. Such a vertical lift includes a lift platform surrounded by vertical walls and one or more doors. Several linear actuators are encased within the walls and are driven by a single motor. Each linear actuator is rigidly attached to the lift platform via a wide, L-shaped connection bracket.

The above-described rigid connection between the lifting bracket and the lift platform can cause the vertical lift to bind during operation. Operating loads, such as the weight of a passenger or a wheelchair, can cause components of the vertical lift to deflect, potentially resulting in a binding condition. Similarly, manufacturing and installation tolerances can cause components to become misaligned, also resulting in a binding condition. Typical tolerances that could potentially result in such a misalignment include, but are not limited to, drive screw end nut run-out, drive screw and component straightness, floor flatness and levelness, and wall perpendicularity and squareness. Binding conditions cause high friction forces and dampen the operation of the machine, thus requiring increased power requirements for the motor. In addition, large and unsightly slots in the walls of the lift assembly are required for the wide brackets to extend from the linear actuators to the platform. Large and obtrusive covers are attached to the brackets to attempt to hide the slots.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a vertical lift platform assembly is provided. The assembly includes a frame, a plurality of vertical support columns fixedly attached to the frame, a plurality of lifting brackets each slidably received within one of the plurality of vertical support columns, a lift platform operatively coupled to the plurality of lifting brackets, and at least one linear actuator operatively coupled to one of the plurality of lifting brackets to translate the lift platform between at least a lowered position and a raised position. At least one of the plurality of lifting brackets provides for a predetermined degree of restriction of the lift platform relative to the respective lifting bracket.

In accordance with another aspect of the present disclosure, a vertical lift platform assembly is provided. The assembly includes a frame, a plurality of vertical support columns fixedly attached to the frame, a plurality of lifting brackets slidably received within the plurality of vertical support columns, a lift platform operatively coupled to the plurality of lifting brackets so that the lift platform is translatable between at least a lowered position and a raised position, and at least one linear actuator comprising a screw threadably engaged to a nut. The nut is flexibly coupled to one of the plurality of lifting brackets by a flexible coupler.

DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION

Exemplary embodiments of the present disclosure will now be described with reference to the accompanying drawings where like numerals correspond to like elements. Exemplary embodiments of the present disclosure are directed to vertical lift platform assemblies. Several embodiments of the present disclosure are directed to vertical lift platform assemblies suitable for use in residential and commercial buildings.

The following discussion proceeds with reference to examples of vertical lift platform assemblies for use in residential and commercial buildings. While the examples provided herein have been described with reference to their association with and use in such buildings, it will be apparent to one skilled in the art that this is done for illustrative purposes and should not be construed as limiting the scope of the present disclosure. Thus, it will be apparent to one skilled in the art that aspects of the present disclosure may be employed in lift assemblies used in other industries and applications. The following detailed description may use illustrative terms such as vertical, horizontal, front, rear, proximal, distal, etc. However, these terms are descriptive in nature and should not be construed as limiting. Further, it will be appreciated that embodiments of the present disclosure may employ any combination of features described herein.

Figure 1:
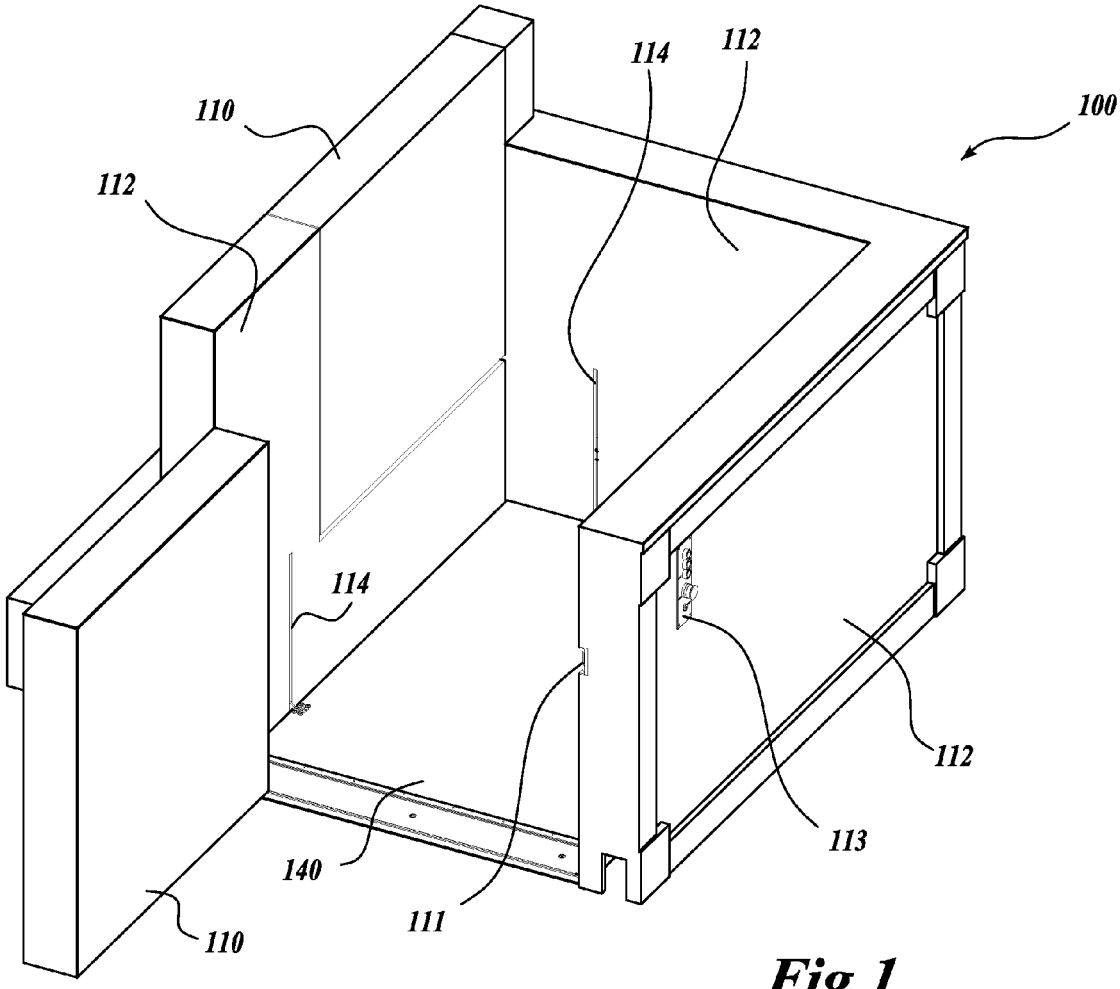
FIG. 1 is an isometric view of a vertical lift platform assembly constructed in accordance with one embodiment of the present disclosure.

FIG. 1 illustrates one suitable embodiment of a vertical lift platform assembly 100 constructed in accordance with aspects of the present disclosure. The vertical lift platform assembly 100 has a lift platform 140, which is translatable in a vertical direction between at least a raised position and a lowered position. The lift platform 140 may be surrounded on all sides by vertically extending walls 112 and one or more doors 110 to provide access to the lift platform 140. A control panel 113 enables an operator to control the vertical travel of the lift platform 140. Suitable locations for a control panel 113 include an interior surface of a wall 112, so that a user can access the control panel 113, and an exterior surface of the wall 112, where the control panel 113 can be manipulated by a third person. Moreover, multiple control panels 113 can be positioned in various locations on or near the lift platform assembly 100.

To use the vertical lift platform assembly 100, a person first ensures that the lift platform 140 is at the same level as the user by raising or lowering the lift platform 140 as necessary by using the control panel 113. When the lift platform 140 is at the user's level, the user enters the vertical lift platform assembly 100 through the appropriate door 110. Once located on the lift platform 140, the user closes the door 110, which is secured by, for example, a latch 111. The lift platform 140 is then raised or lowered using a control panel 113. When the lift platform 140 has reached the desired elevation, the user exits through the appropriate door 110. In this manner, a user can be transported safely between at least a first and a second elevation. Alternatively, the door operation can be powered and controlled by control panel 113.

Figure 2A:
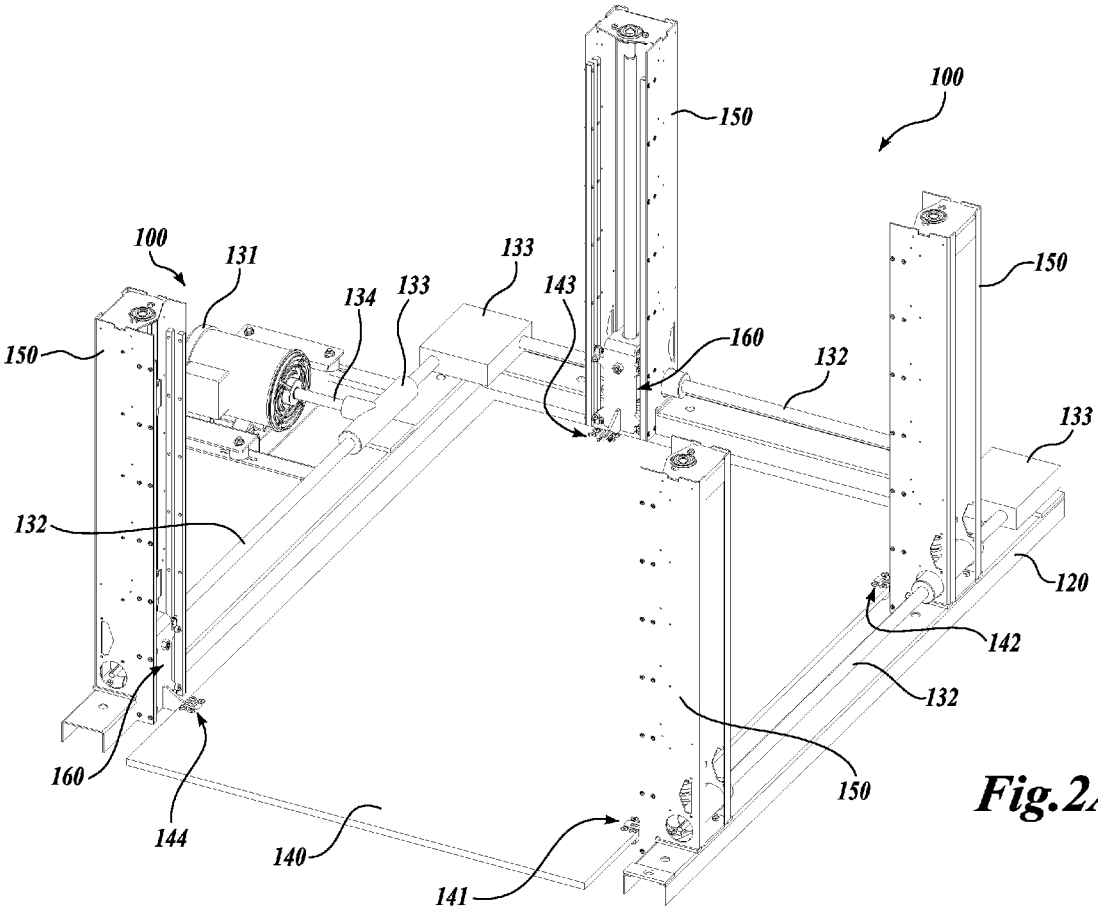
FIG. 2A is an isometric view of one suitable embodiment of a drive mechanism of the vertical lift platform assembly shown in FIG. 1, wherein the lift platform is in a lowered position.
Figure 2B:
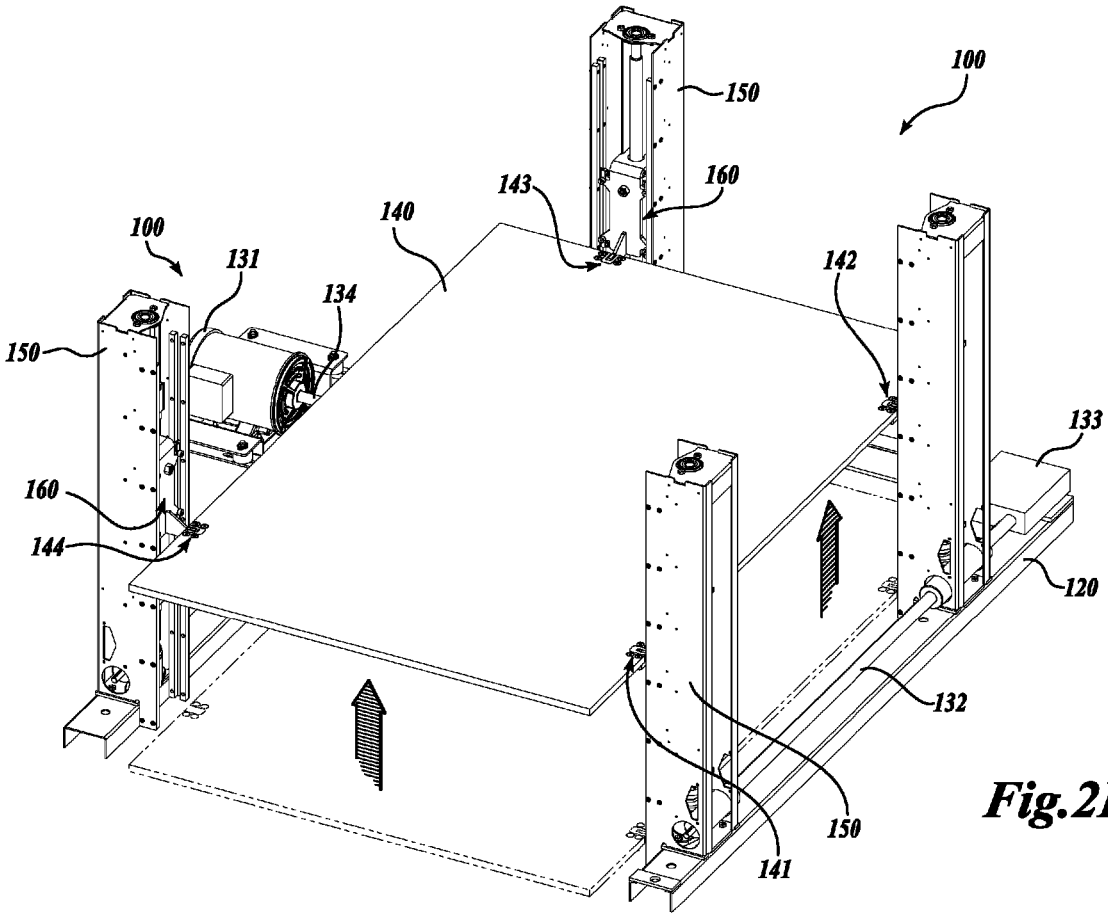
FIG. 2B is an isometric view of one suitable embodiment of a drive mechanism of the vertical lift platform assembly shown in FIG. 1, wherein the lift platform is in a raised position.

Referring now to FIGS. 2A and 2B, the vertical lift platform assembly 100 is shown with the walls 112 and the doors 110 removed. The vertical lift platform assembly 100 includes a frame 120, a plurality of vertical support columns 150, a plurality of lifting brackets 160, and the lift platform 140. Lifting means are used to reciprocate the lift platform 140 between a raised position, shown in FIG. 2B, and a lowered position, shown FIG. 2A. In one embodiment, the lifting means include a drive assembly 130 operatively coupled to a number of linear actuators 200 (See FIGS. 8 and 9). Each linear actuator 200 is operatively coupled to one lifting bracket 160, which is in turn coupled to the lift platform 140. As such, actuation of the linear actuators 200 via the drive assembly 130 translates the lifting brackets, and in turn, the lift platform 140.

The lift platform 140 includes a generally flat lift deck, which is sized and configured to hold a user in a wheelchair without substantial deflection. Accordingly, the lift platform 140, including the lift deck, is preferably constructed of steel or aluminum, but any material of suitable strength and durability may be used.

The frame 120 forms the base of the vertical lift platform assembly 100. While the frame 120 shown in FIG. 2A is U-shaped and slightly larger than the periphery of the lift platform 140, it can be appreciated that the frame 120 may be of any suitable size and shape to support the vertical support columns 150 described hereinafter. Further, the frame 120 is preferably constructed of steel or aluminum, although any material of suitable strength and durability may be used.

The vertical support columns 150 are rigidly attached to the frame 120 around the periphery of the lift platform 140 and extend vertically from the frame 120. Each column 150 is constructed to have an interior cavity sized to contain a lifting bracket 160 and a linear actuator 200. Although four vertical support columns 150 are shown in FIGS. 2A and 2B, the number and location of the vertical support columns 150 may vary with, for example, the loads to be lifted by the lift platform assembly 100, the size of the lift platform 140, and the locations of the doors 110.

The drive assembly 130 drives the linear actuators 200 in order to translate the lifting brackets 160 within the vertical support columns 150. In one suitable embodiment, the drive assembly 130 includes a motor 131 having an output shaft 134 connected to a plurality of suitable arranged drive shafts 132 via drive shaft couplers 133. Each drive shaft coupler 133 includes suitable gears and the like appropriately arranged for transferring the rotation of the following: 1) the output shaft 134 to the drive shafts 132; 2) a drive shaft 132 to a drive shaft 132; and 3) a drive shaft 132 to the linear actuator 200, as will be described in more detail below. As shown best in FIG. 2A, the path of the drive shafts 132 preferably follows the shape of the frame 120; however, the drive shafts may follow any suitable path between the output shaft 134 of the motor 131 and the linear actuators 200.

In operation, the motor 131 rotates the output shaft 134, which in turn, rotates the drive shafts 132 coupled thereto, thereby providing an actuating force for the linear actuators 200. The motor 131 is selectively reversible so that the drive shafts 132 can be rotated in either direction, thereby allowing the linear actuators 200 to raise and lower the lifting brackets 160, as will be described in detail below.

Figure 3:
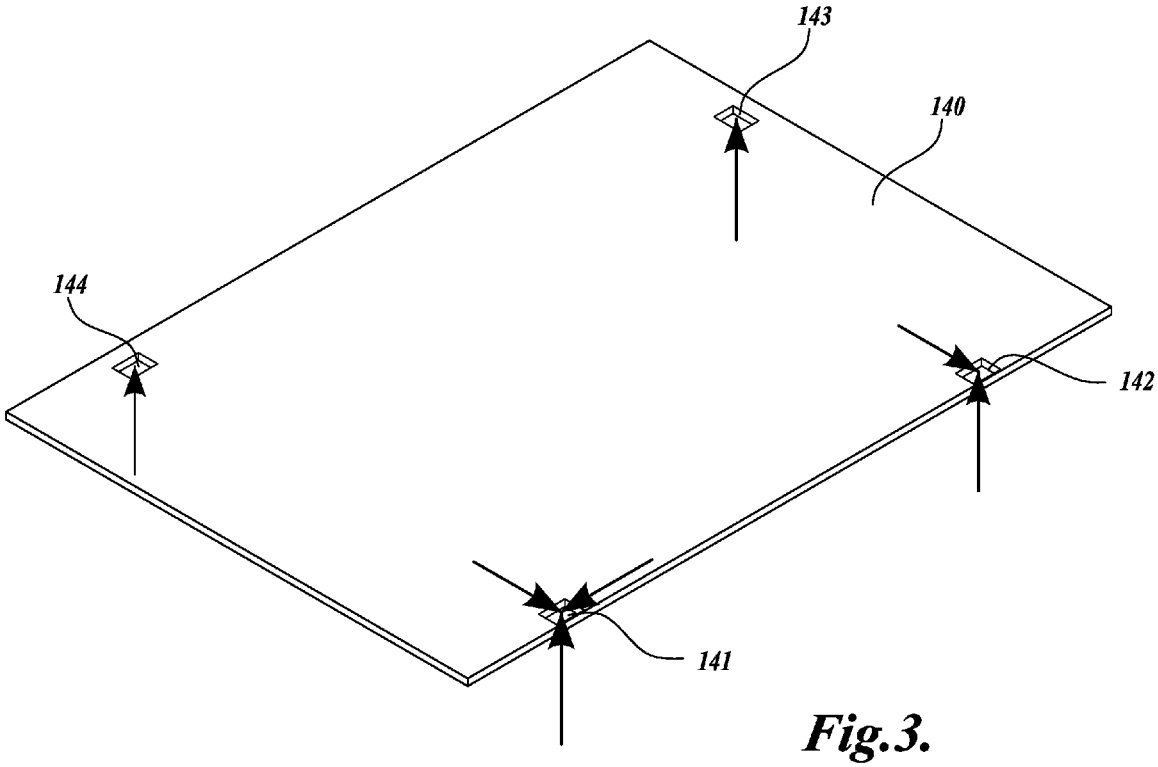
FIG. 3 is an isometric view of the lift platform of the vertical lift platform assembly shown in FIG. 1.

In accordance with aspects of the present disclosure, the lift platform 140 is supported in a manner that reduces the risk of a binding condition when actuated between the raised and lowered positions. To that end, please refer to FIG. 3, where the attachment points 141, 142, 143, 144 indicate one example of locations at which the lift platform 140 is attached to lifting brackets 160. As will be described in detail below, each attachment point provides for a predetermined degree of restriction of the lift platform 140 relative to its respective lifting bracket 160. In particular, each attachment point, as will be described in more detail below, is configured to restrict translation of the lift platform 140 relative to its respective lifting bracket 160 in a predetermined, limited number of directions. In a non-limiting example, the directions in which translation at each attachment point is restricted is indicated in FIG. 3 by an arrow. As a result, the lift platform 140 may deflect due to applied loads without causing a binding condition between the lift platform 140 and the lifting brackets 160. It will be appreciated, however, that other combinations of attachment points and restricted directional movement are within the scope of the present disclosure.

Still referring to the embodiment of FIG. 3, the first attachment point 141, for example, restricts translation of the lift platform 140 in a generally vertical direction, a first generally horizontal direction, and a second generally horizontal direction orthogonal to the first generally horizontal direction. The second attachment point 142, for example, restricts translation of the lift platform in the generally vertical direction and the first generally horizontal direction. The third attachment point 143 and the fourth attachment point 144, for example, restrict translation of the lift platform 140 in the generally vertical direction. Although the first attachment point 141, the second attachment point 142, and the third attachment point 143 are sufficient to restrain the lift platform 140 from translation in all directions, the fourth attachment point 144 prevents the lift platform 140 from excessive deflection, while adding a minimal risk of binding.

Figure 4:
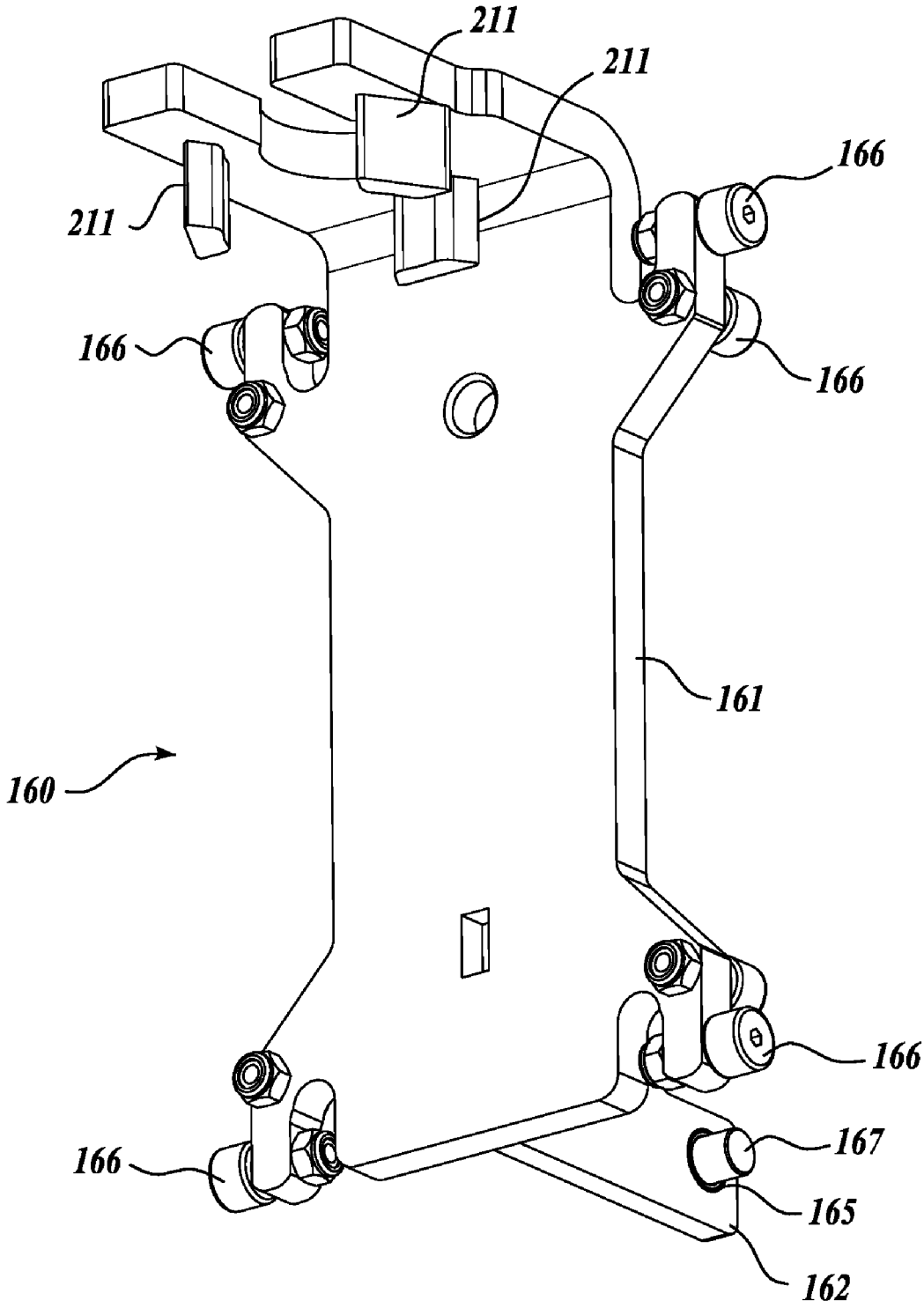
FIG. 4 is an isometric view of one suitable embodiment of a lifting bracket of the vertical lift platform assembly shown in FIG. 1.
Figure 5:
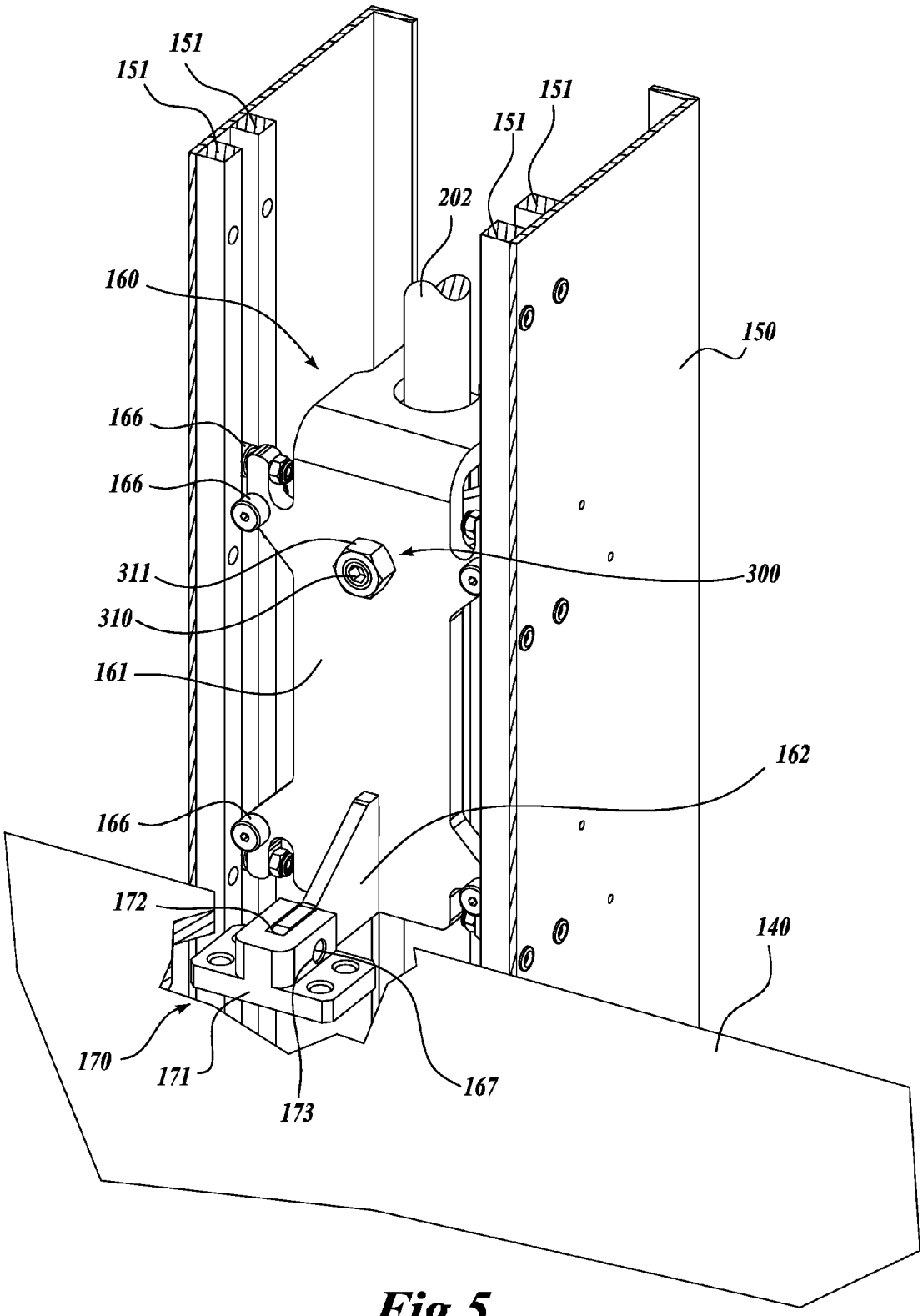
FIG. 5 is an isometric view showing one suitable embodiment of the attachment configuration between the lifting bracket and the lift platform suitable for achieving the first attachment point of FIG. 3.
Figure 6:
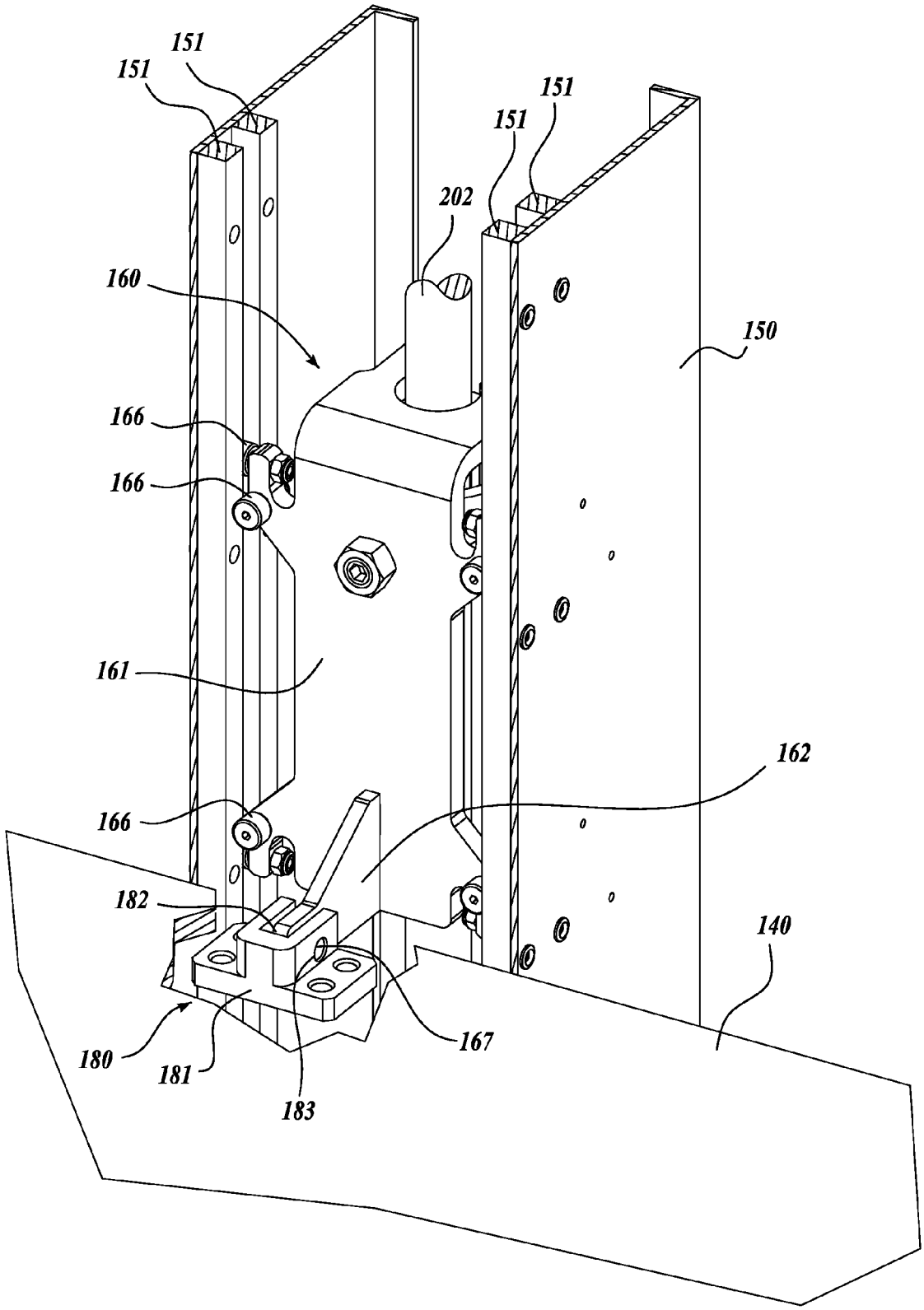
FIG. 6 is an isometric view showing one suitable embodiment of the attachment configuration between the lifting bracket and the lift platform suitable for achieving the second attachment point of FIG. 3.
Figure 7:
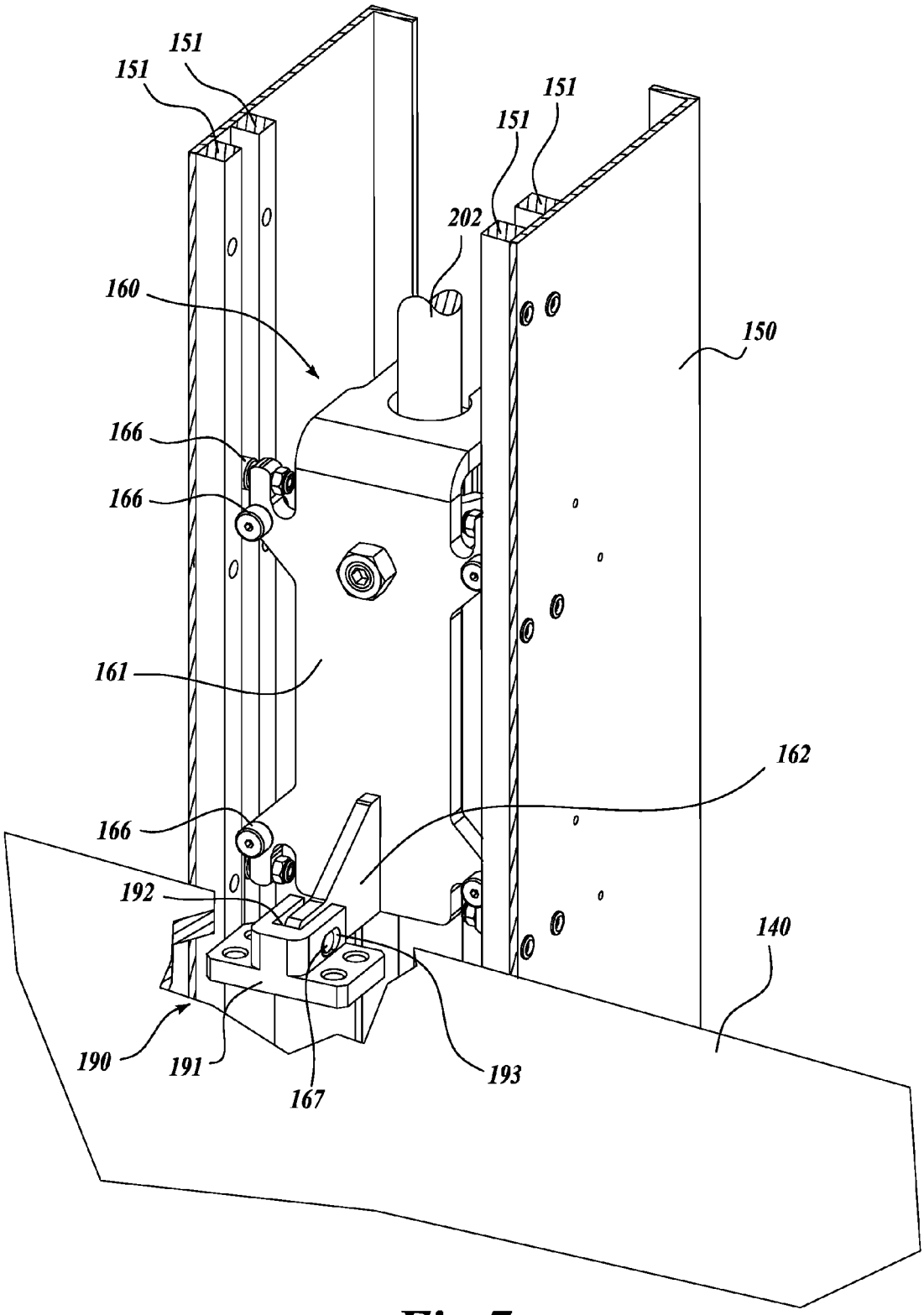
FIG. 7 is an isometric view showing one suitable embodiment of the attachment configuration between the lifting bracket and the lift platform suitable for achieving the third and fourth attachment points of FIG. 3.

Referring now to FIG. 4, one embodiment of a lifting bracket 160 will be described in greater detail. As best shown in FIG. 4, the lifting bracket 160 includes a generally L-shaped carriage 161 wherein the longer leg of the "L" extends in a vertical direction, and the shorter leg extends of the "L" extends in a horizontal direction. A number of rollers 166 are rotationally coupled to the carriage 161 so that the axis of rotation of each roller 166 is in a generally horizontal direction. As shown in FIGS. 5-7, guides 151 are fixedly attached to the interior surfaces of the vertical support columns 150, extending in a vertical direction. The guides 151 cooperate with the rollers 166 to restrain the movement of the carriage 161 in a first generally horizontal direction and a second generally horizontal direction. However, the rollers 166 and the guides 151 do not hinder translation of the carriage 161 in a generally vertical direction. As a result, each carriage 161 is free to slide or roll up and down in a generally vertical direction within the vertical support column 150 in which the carriage 161 is disposed.

Referring back to FIG. 4, the lifting bracket 160 includes a lug 162 that extends from a vertical face of the carriage 161 in a direction opposite to that of the shorter leg of the L-shaped carriage 161. The lug 162 is oriented in a generally vertical direction. A round pin aperture 165 is disposed within the lug and has a generally horizontal axis. The pin aperture 165 is sized to accept a pin 167 that couples the lug 162 of the lifting bracket 160 to the lift platform 140, as described further below. The narrow profile of lug 162 fits through wall 112 at narrow slot 114. This narrow configuration allows an unobtrusive attachment to platform 140 without the use of covers.

Figure 2C:
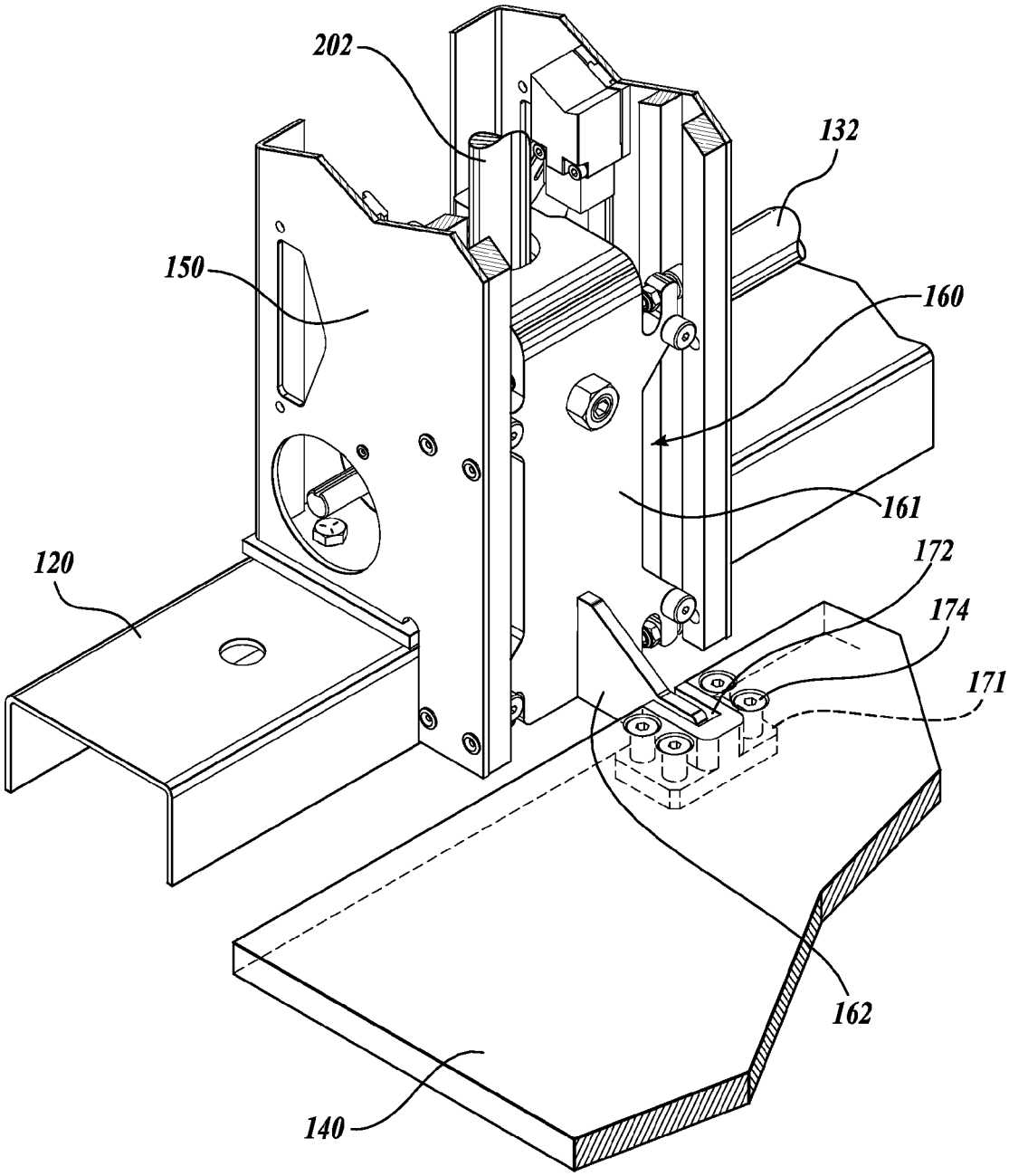
FIG. 2C is a partial isometric view of one embodiment of an attachment configuration that couples the lift platform of the vertical lift platform assembly to a lifting bracket.

FIG. 5 shows one embodiment of the attachment configuration 170 between the lifting bracket 160 and the lift platform 140 suitable for achieving the first attachment point 141 shown in the embodiment of FIG. 3. As best shown in FIG. 5, an attachment configuration 170 is formed between the lug 162 and a clevis fitting 171. To that end, the clevis fitting 171 has a generally flat base in a horizontal direction and a vertical protrusion extending upwardly therefrom. The clevis fitting 171 is fixedly attached to the lift platform 140 by fasteners 174 (See FIG. 2C), such as bolts, screws, etc., extending vertically through the base portion of the clevis fitting and into the lift platform 140 (See FIG. 2C). Alternately, the clevis fitting 171 may be fixedly attached to the lift platform 140 by an interference fit, adhesives, welding, or any other suitable method. The features of the clevis fitting 171, such as the narrow slot 172 and the round hole 173 described hereinafter, may also be integrally formed with the lift platform 140, eliminating the need for a separate clevis fitting 171.

The clevis fitting 171 defines a narrow slot 172 extending in a vertical direction and opening toward the periphery of the lift platform 140. The narrow slot 172 is sized to accept the lug 162 of a lifting bracket 160 in a loosely seated manner. The vertical protrusion portion of the clevis fitting 171 includes a round hole 173, the axis of which is in a generally horizontal direction and extends normal to the interior faces of the narrow slot 172. The hole is sized to accept the pin 167. The lifting bracket 160 is attached to the lift platform 140 by inserting the lug 162 into the narrow slot 172 so that the pin aperture 165 in the lug 162 is coaxially aligned with the round hole 173 of the clevis fitting 171. The pin 167 is inserted into the round hole 173 and the pin aperture 165, thereby securing the lifting bracket 160 to the lift platform 140.

When assembled, the pin 167 restricts translation of the lift platform 140 relative to the lifting bracket 160 in a generally vertical direction and a generally horizontal direction normal to the axis of the pin 167. Further, if the lift platform 140 attempts to move in a horizontal direction parallel to the axis of the pin 167, the vertical face of the lug 162 will come into contact with an interior vertical face of the narrow slot 172. Thus, the vertical face of the lug 162 will restrict translation of the lift platform 140 in a horizontal direction parallel to the axis of the pin 167.

Manufacturing tolerances and designed-in clearances between the narrow slot 172 and the lug 162, the pin 167 and the round hole 173, and the pin 167 and the pin aperture 165 allow the lug 162 to rotate relative to the clevis fitting 171. Thus, little to no binding occurs during normal operation or during platform deflection due to passenger loading. While rotation around a vertical axis and a horizontal axis perpendicular to the axis of the pin 167 is limited to a predetermined range, the lug 162 and clevis fitting 171 are generally free to rotate relative to each other about the axis of the pin 167 without limitation.

FIG. 6 shows one embodiment of the attachment configuration 180 between the lifting bracket 160 and the lift platform 140 suitable for achieving the second attachment point 142 shown in the embodiment of FIG. 3. The attachment configuration 180 shown in FIG. 6 is substantially identical to the attachment configuration 170 shown in FIG. 5 except for the geometry of the clevis fitting 181. The clevis fitting 181 of FIG. 6 is substantially identical to the clevis fitting 171 of FIG. 5 except that instead of having a narrow slot 172 in which the lug loosely seats therein, the clevis fitting 181 has a relatively wide slot 182. As a result, the attachment configuration 180 does not resist translation parallel the axis of the second pin 167. In particular, the wide slot 182 is sized to ensure sufficient clearance between an internal wall of the wide slot 182 and a side of the lug 162 so the lug 162 and the clevis fitting 181 do not come into contact when a translation force is applied to the lift platform 140 in the direction of the axis of the second pin 167. Hole 183 is identical to corresponding hole 173 of FIG. 5.

FIG. 7 shows one embodiment of the attachment configuration 190 between the lifting bracket 160 and the lift platform 140 suitable for achieving the third attachment point 143 and the fourth attachment point 144 shown in the example of FIG. 3. The attachment configuration 190 shown in FIG. 7 is substantially identical to the attachment configuration 180 shown in FIG. 6, except that the round hole 183 of FIG. 6 is replaced by a slotted hole 193. The slotted hole 193 is elongated in a horizontal direction so that the third or fourth pin 167 is free to move relative to the clevis fitting 191 in the slot 193. As a result, the lift platform 140 is free to translate relative to the third or fourth lifting brackets 160 in both horizontal directions. Because the slotted hole 193 is not elongated in a vertical direction, translation of the lift platform 140 relative to the lifting bracket 160 is restricted in a vertical direction. Slot 192 is identical to corresponding wide slot 182 of FIG. 6. Thus, the attachment configurations 170, 180, 190 allow for misalignment, yet provide a laterally solid support for the platform 140.

Figure 8:
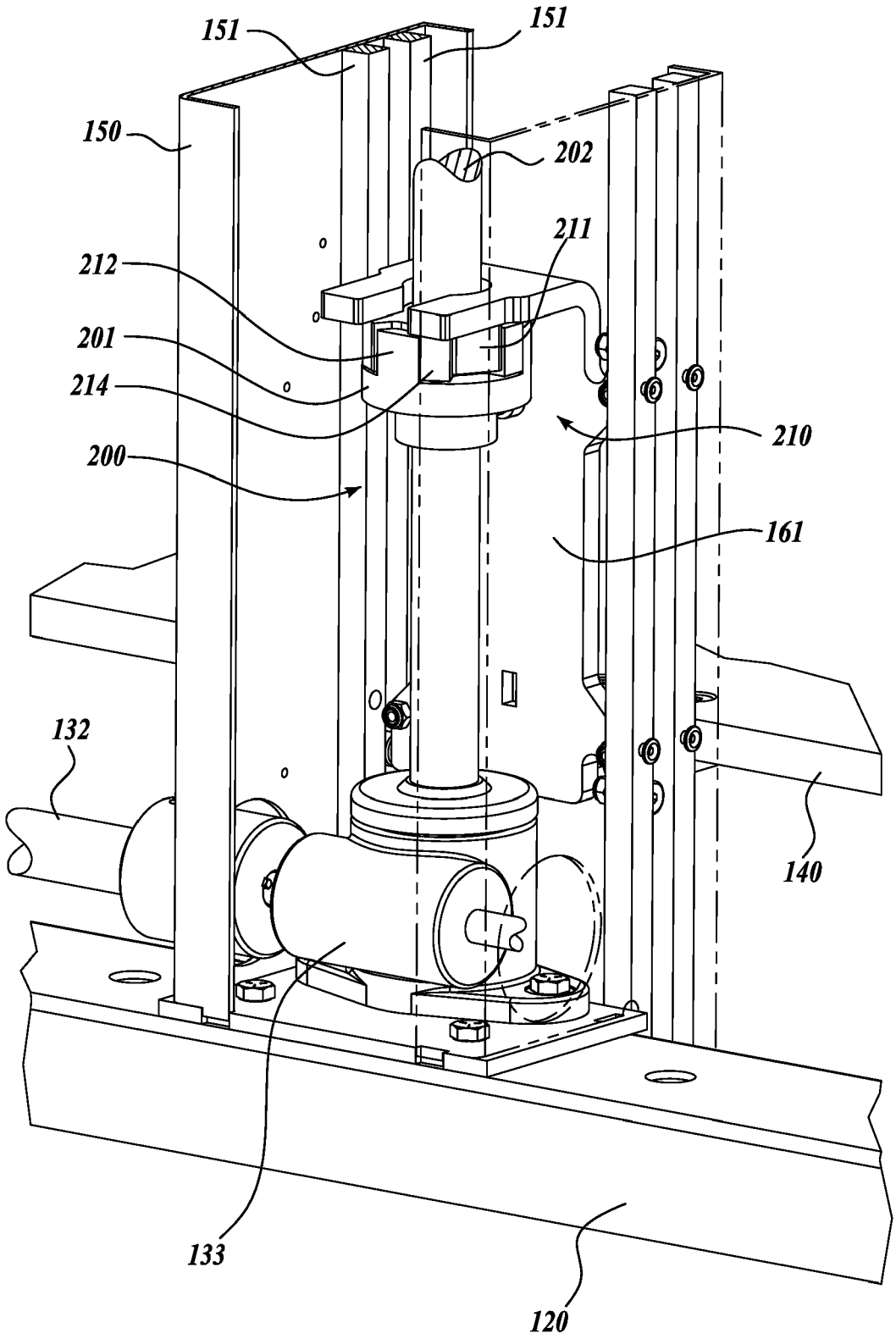
FIG. 8 is an isometric view of one suitable embodiment of a flexible coupler of the lift platform assembly shown in FIG. 1.
Figure 9:
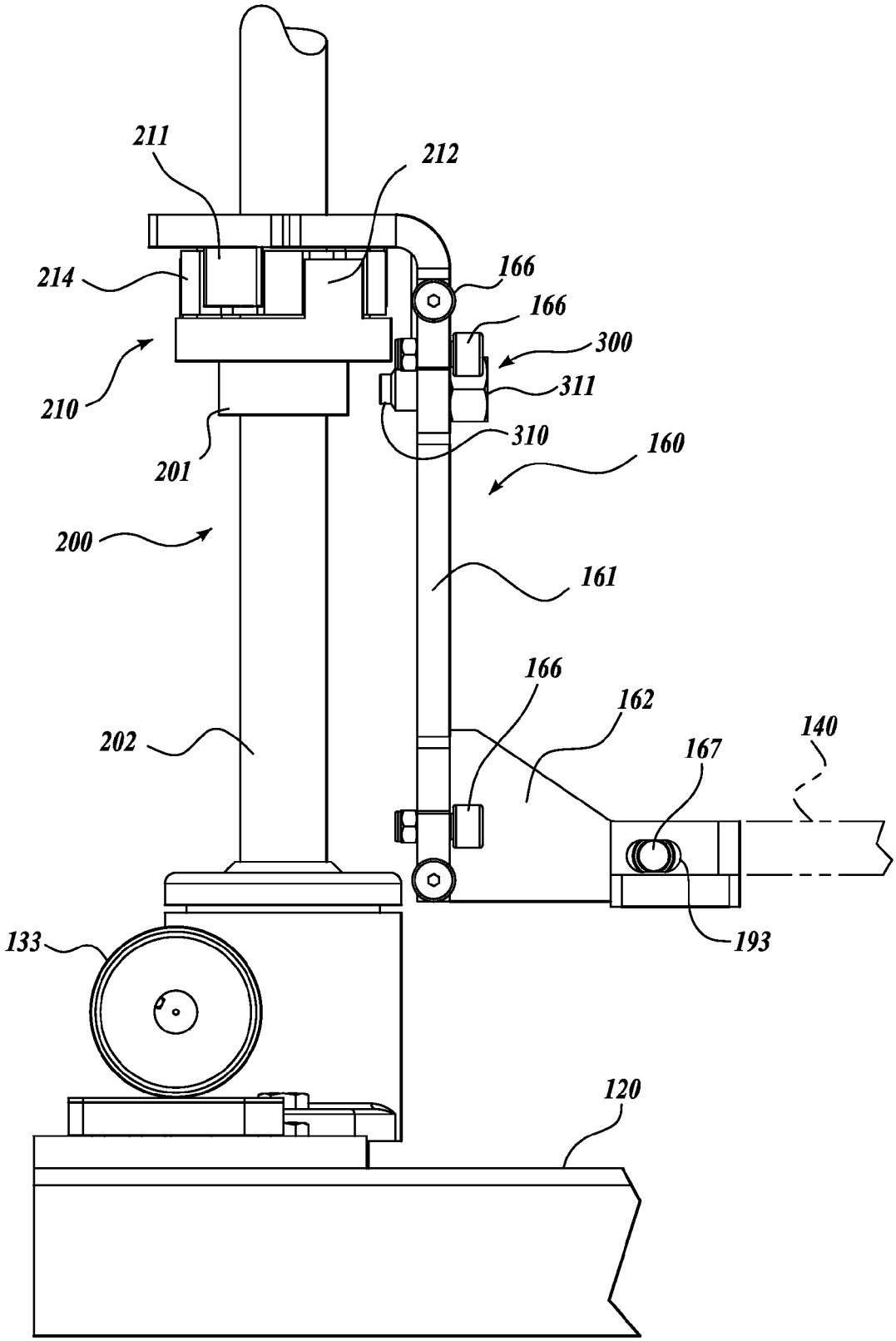
FIG. 9 is a side view of the flexible coupler shown in FIG. 8.

Referring now to FIGS. 8 and 9, one embodiment of the linear actuator 200 will be described in more detail. As best shown in FIGS. 8 and 9, the linear actuator 200 may be a jack screw composed of a nut 201 and a drive screw 202. The drive screw 202 extends vertically from a drive shaft coupler 133. The drive shaft coupler 133 operatively couples the drive screw 202 and a horizontal drive shaft 132 so that the rotational motion of the drive shaft 132 causes rotation of the drive screw 202 about its centerline. The nut 201 is threadably engaged to the drive screw 202 in a conventional manner. Accordingly, the nut 201 moves vertically along the axis of the drive screw 202 when there is relative rotation between the nut 201 and the drive screw 202.

Figure 10:
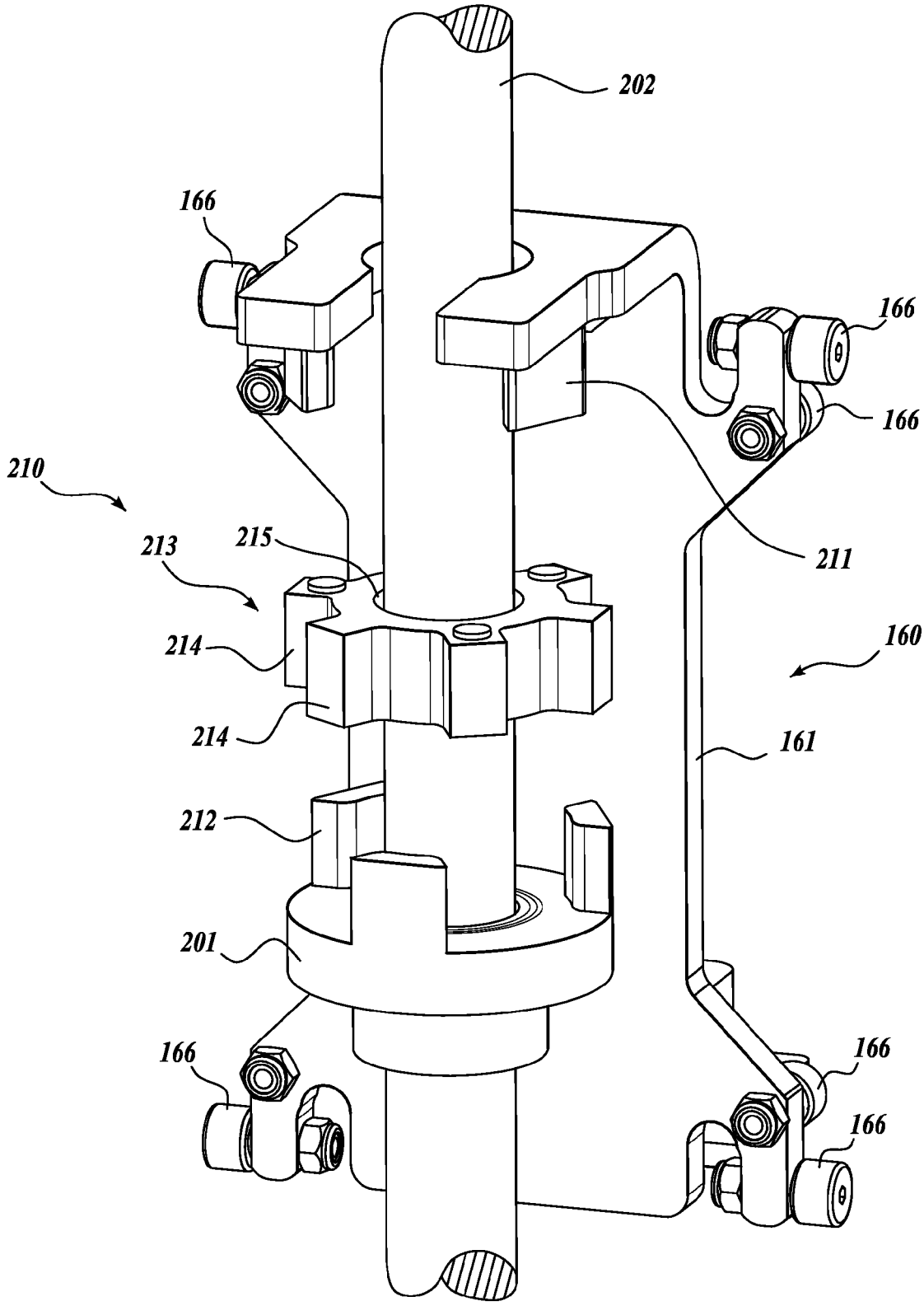
FIG. 10 is an exploded isometric view of a flexible coupler shown in FIG. 8.

As shown in FIGS. 8-10, the nut 201 is coupled to the lifting bracket 160 through a flexible coupler 210. The flexible coupler 210 generally prevents the nut 201 from rotating about the centerline of the drive screw 202 relative to the lifting bracket 160. Further, the guides 151 of the vertical support column 150 prevent the lifting bracket 160 from rotating relative to the centerline of the drive screw 202. Consequently, when the drive screw 202 rotates about its centerline, relative rotation occurs between the nut and the drive screw 202, and, as a result, the nut moves in a vertical direction up or down relative to the drive screw 202. It will be appreciated that the flexible coupler 210 can act like a spherical bearing, and thus, the flexibility of the coupler 210 allows for misalignment between the centerline of the drive screw 202 and the vertical path of travel of the lifting bracket 160 without causing binding.

Referring now to FIG. 10, one embodiment of the flexible coupler 210 will be described in detail. As best shown in FIG. 10, the flexible coupler 210 includes a first series of protrusions 211 that are fixedly attached to the lifting bracket 160. The protrusions 211 extend vertically downward from the lower face of the horizontal section of the carriage 161 and are located so as to be spaced circumferentially around the centerline of the drive screw 202 when the lift platform assembly 100 is assembled. The protrusions 211 may be integrally formed with the carriage 161 or separately manufactured and fixedly attached by any suitable means.

The flexible coupler 210 also includes a second series of protrusions 212 that extend from the upper surface of the nut 201. The protrusions 212 are spaced circumferentially around the centerline of the nut 201. Similar to the first series of protrusions 211, the second series of protrusions 212 may be integrally formed with the nut 201 or separately formed and attached by any suitable method such as adhesives, mechanical fasteners, welding, heat bonding, etc.

The flexible coupler 210 further includes a cogged element 213, preferable constructed from a suitable material, such as metal or durable polymeric material, disposed between the nut 201 and the carriage 161. The cogged element 213 includes a hole 215 oversized to allow the drive screw 202 to pass through the cogged element 213. A series of cogs 214 extend radially from the perimeter of the cogged element 213. The resultant spaces between the cogs 214 of the cogged element 213 are sized and spaced to alternately receive the first series of protrusions 211 from the lifting bracket 160 and the second series of protrusions 212 from the nut 201. The protrusions 211 extending from the lifting bracket 160 engage the cogs 214 of the cogged element 213, thereby preventing the cogged element from rotating about the centerline of the drive screw 202 relative to the lifting bracket 160. Similarly, the protrusions 212 extending from the nut 201 engage alternate cogs 214 of the cogged element 213, thereby preventing the nut 201 from rotating about the drive screw 202 centerline relative to the cogged element 213. In this way, the nut 201 is prevented from rotating about the centerline of the drive screw 202 relative to the lifting bracket 160.

The first series of protrusions 211 and second series of protrusions 212 are sized to be slightly smaller than the spaces between the cogs 214 of the cogged element 213. The resultant clearance between the first protrusions 211 and the cogs 214 and the second protrusions 212 and the cogs 214 provides a limited amount of play between the nut 201 and the lifting bracket 160. Accordingly, because the nut 201 is not rigidly attached to the lifting bracket 160, the flexible coupler 210 can accommodate misalignment between the centerline of the drive screw 202 and the direction of travel of the lifting bracket 160.

Referring to FIG. 9, retainer assembly 300, which is fixed to lifting bracket 160, prevents separation of flexible coupler 210. Setscrew 310 is threadably received by carriage 161 and extends from carriage 161 to fit generally underneath nut 201. Jam nut 311 secures setscrew 310 to carriage 161. Relative vertical movement of nut 201 with respect to carriage 161 is restricted by the contact of nut 201 with setscrew 310.

While illustrative embodiments have been illustrated and described, it will be appreciated that various changes can be made therein without departing from the spirit and scope of the invention.

The embodiments of the invention in which an exclusive property or privilege is claimed are defined as follows:

1. A vertical lift platform assembly, comprising:

first and second vertical support columns;

first and second lifting brackets, each lifting bracket slidably received within one of the first and second vertical support columns and movable in a generally vertical direction;

a lift platform operatively coupled to the first and second lifting brackets by first and second attachment configurations, respectively, each attachment configuration defining orthogonally disposed vertical, longitudinal, and lateral axes;

at least one linear actuator operatively coupled to at least one of the first and second lifting brackets to translate the lift platform between at least a lowered position and a raised position; and wherein the first attachment configuration substantially restricts translational movement of the lift platform with respect to the first lift bracket along the vertical axis, the longitudinal axis, and the lateral axis, and wherein the second attachment configuration substantially restricts translational movement of the lift platform with respect to the second lift bracket along the vertical axis and only one of the longitudinal axis and the lateral axis.

2. The vertical lift platform assembly of claim 1, wherein at least one lifting bracket comprises a substantially vertical lug.

3. The vertical lift platform assembly of claim 2, wherein at least one clevis is fixedly attached to the lift platform, each clevis being rotationally coupled to the lug of a lifting bracket.

4. The vertical lift platform assembly of claim 1, wherein at least one of the first and second lifting brackets further comprises a flexible coupler that acts like a spherical bearing to operatively connect the lifting bracket to the linear actuator.

5. The vertical lift platform assembly of claim 1, wherein a plurality of rollers is rotationally coupled to the lifting brackets so that at least one of the plurality of rollers operatively engages a surface of one of the plurality of vertical support columns to substantially restrain translation of the lifting bracket in directions substantially orthogonal to the direction of lift platform movement.

6. The vertical lift platform assembly of claim 1, further comprising a drive assembly that drives the at least one linear actuator.

7. The vertical lift platform assembly of claim 1, wherein the first and second lifting brackets are slidably received within the first and second vertical support columns in a manner that restrains translation of the lifting bracket in directions substantially orthogonal to the direction of lift platform movement.

8. A vertical lift platform assembly, comprising:

a plurality of vertical support columns;

first, second and third lifting brackets, each lifting bracket slidably received within one of the plurality of vertical support columns and movable in a generally vertical direction;

a lift platform operatively coupled to the first, second and third lifting brackets by first, second, and third attachment configurations, respectively;

at least one linear actuator operatively coupled to one of the first, second, and third lifting brackets to translate the lift platform between at least a lowered position and a raised position; wherein the first attachment configuration substantially restricts translational movement of the lift platform solely in the generally vertical direction, a first generally horizontal direction, and a second generally horizontal direction that is perpendicular to the first generally horizontal direction;

the second attachment configuration substantially restricts translational movement of the lift platform solely in the generally vertical direction and the first generally horizontal direction; and the third attachment configuration substantially restricts translational movement of the lift platform solely in the generally vertical direction.

9. The vertical lift platform assembly of claim 8, further comprising a fourth lifting bracket operatively coupled to the lift platform by a fourth attachment configuration that substantially restricts translational movement of the lift platform with respect to the fourth lift bracket solely in the generally vertical direction.

10. A vertical lift platform assembly, comprising:

a plurality of vertical support columns;

first, second, and third lifting brackets, each lifting bracket slidably received within one of the plurality of vertical support columns and movable in a generally vertical direction;

a lift platform operatively coupled to by first, second, and third lifting brackets;

at least one linear actuator operatively coupled to one of the first, second, and third lifting brackets to translate the lift platform between at least a lowered position and a raised position;

wherein the first, second, and third lifting brackets are coupled to the lift platform by first, second, and third joints, respectively, and wherein:

the first joint substantially restricts translation of the lift platform with respect to the first lift bracket in three or fewer directions consisting of a generally vertical direction, a generally longitudinal direction, and a generally lateral direction that is substantially orthogonal to the generally longitudinal direction;

the second joint substantially restricts translation of the lift platform with respect to the second lift bracket in two or fewer directions consisting of a generally vertical direction, and a generally longitudinal direction; and the third joint substantially restricts translation of the lift platform with respect to the third lift bracket only in a generally vertical direction.

11. A vertical lift platform assembly, comprising:

a plurality of vertical support columns;

a plurality of lifting brackets, each lifting bracket slidably received within one of the plurality of vertical support columns and movable in a generally vertical direction;

a lift platform operatively coupled to the plurality of lifting brackets so that the lift platform is translatable between at least a lowered position and a raised position, the plurality of lifting brackets being coupled to the lift platform by a plurality of joints, wherein the plurality of joints includes:

a first joint that substantially restricts translation of the lift platform with respect to a first lift bracket of the plurality of lift brackets in three or fewer directions consisting of a generally vertical direction, a generally longitudinal direction, and a generally lateral direction that is substantially orthogonal to the generally longitudinal direction;

a second joint that substantially restricts translation of the lift platform with respect to the second lift bracket of the plurality of lift brackets in two or fewer directions consisting of a generally vertical direction and a generally longitudinal direction; and a third joint that substantially restricts translation of the lift platform with respect to a third lift bracket of the plurality of lift brackets only in a generally vertical direction; and at least one linear actuator, each linear actuator comprising a screw threadably engaged to a nut, wherein at least one nut is flexibly coupled to one of the plurality of lifting brackets by a flexible coupler;

wherein the flexible coupler comprises:

a cogged element disposed between the nut and the lifting bracket, the cogged element having a plurality of cogs;

at least one first protrusion fixedly attached to the lifting bracket, the at least one first protrusion operatively engaged with at least one of the plurality of cogs of the cogged element; and at least one second protrusion fixedly attached to the nut, the at least one second protrusion operatively engaged with at least one of the plurality of cogs of the cogged element, wherein the cogged element, the at least one first protrusion, and at least one second protrusion are sized to provide for misalignment between the nut and the lifting bracket.

12. The vertical lift platform assembly of claim 11, wherein the cogged element comprises a polymeric material.

13. A vertical lift platform assembly, comprising:

first and second vertical support columns;

first and second lifting brackets, each lifting bracket slidably received within one of the first and second vertical support columns and movable along a vertical direction;

a lift platform operatively coupled to the first and second lifting brackets by first and second joints, respectively;

at least one actuator operatively coupled to at least one of the first and second lifting brackets to translate the lift platform between at least a lowered position and a raised position;

wherein the first joint substantially restricts translational movement of the lift platform along two or more orthogonal axes, the orthogonal axes consisting of a vertical axis, a longitudinal axis, and a lateral axis, and wherein the second joint substantially restricts movement of the lift platform solely along a vertical axis.

* * * * *